US011092143B2

(12) United States Patent
Lehmann et al.

(10) Patent No.: US 11,092,143 B2
(45) Date of Patent: Aug. 17, 2021

(54) VISCOUS MATERIAL PUMP WITH ADJUSTABLE LIMITATION OF THE DELIVERY PRESSURE

(71) Applicant: Schwing GmbH, Herne (DE)

(72) Inventors: Andreas Lehmann, Moers (DE); Anke Wiedermann, Dortmund (DE)

(73) Assignee: SCHWING GMBH, Herne (DE)

( * ) Notice: Subject to any disclaimer, the term of this patent is extended or adjusted under 35 U.S.C. 154(b) by 217 days.

(21) Appl. No.: 16/462,412

(22) PCT Filed: Nov. 21, 2017

(86) PCT No.: PCT/EP2017/079962

§ 371 (c)(1),
(2) Date: May 20, 2019

(87) PCT Pub. No.: WO2018/091747

PCT Pub. Date: May 24, 2018

(65) Prior Publication Data

US 2019/0309737 A1 Oct. 10, 2019

(30) Foreign Application Priority Data

Nov. 21, 2016 (DE) ..... 10 2016 122 392.1

(51) Int. Cl.
*F04B 1/02* (2006.01)
*F04B 1/34* (2006.01)
(Continued)

(52) U.S. Cl.
CPC ..... *F04B 1/02* (2013.01); *F04B 1/34* (2013.01); *F04B 9/1172* (2013.01); *F04B 15/02* (2013.01);
(Continued)

(58) Field of Classification Search
CPC ..... F04B 1/02; F04B 49/22; F04B 49/002; F04B 15/02; F04B 9/1172; F04B 1/34;
(Continued)

(56) References Cited

U.S. PATENT DOCUMENTS 5,101,629 A * 4/1992 Sugiyama ..... E02F 9/2221 60/459
5,993,181 A * 11/1999 Hudelmaier ..... F04B 7/0034 417/519
2008/0016862 A1* 1/2008 Von Baumen ..... E04G 21/0436 60/464

FOREIGN PATENT DOCUMENTS

DE 3709504 A1 * 10/1988 ..... F15B 13/0417
DE 3709504 A1 10/1988
(Continued)

OTHER PUBLICATIONS

DE3709504 translation (Year: 2021).*
(Continued)

*Primary Examiner* — Devon C Kramer
*Assistant Examiner* — David N Brandt
(74) *Attorney, Agent, or Firm* — Faegre Drinker Biddle & Reath LLP

(57) ABSTRACT

A thick matter pump includes a hydraulically-driven two-cylinder piston-pump configured to generate a thick matter delivery pressure. The thick matter pump also includes a hydraulic pump configured to apply hydraulic fluid to the two-cylinder piston-pump via a drive line. The hydraulic pump includes a pressure regulator that is adjustable to a target value of pressure of the hydraulic fluid for limiting the thick matter delivery pressure, and the thick matter delivery pressure is adjustably limited. The pressure of the hydraulic fluid is limited in the drive line, via an adjustable pressure-limiting valve, to an adjustable maximum pressure. The target pressure of the pressure regulator and the maximum
(Continued)

Figure 1:
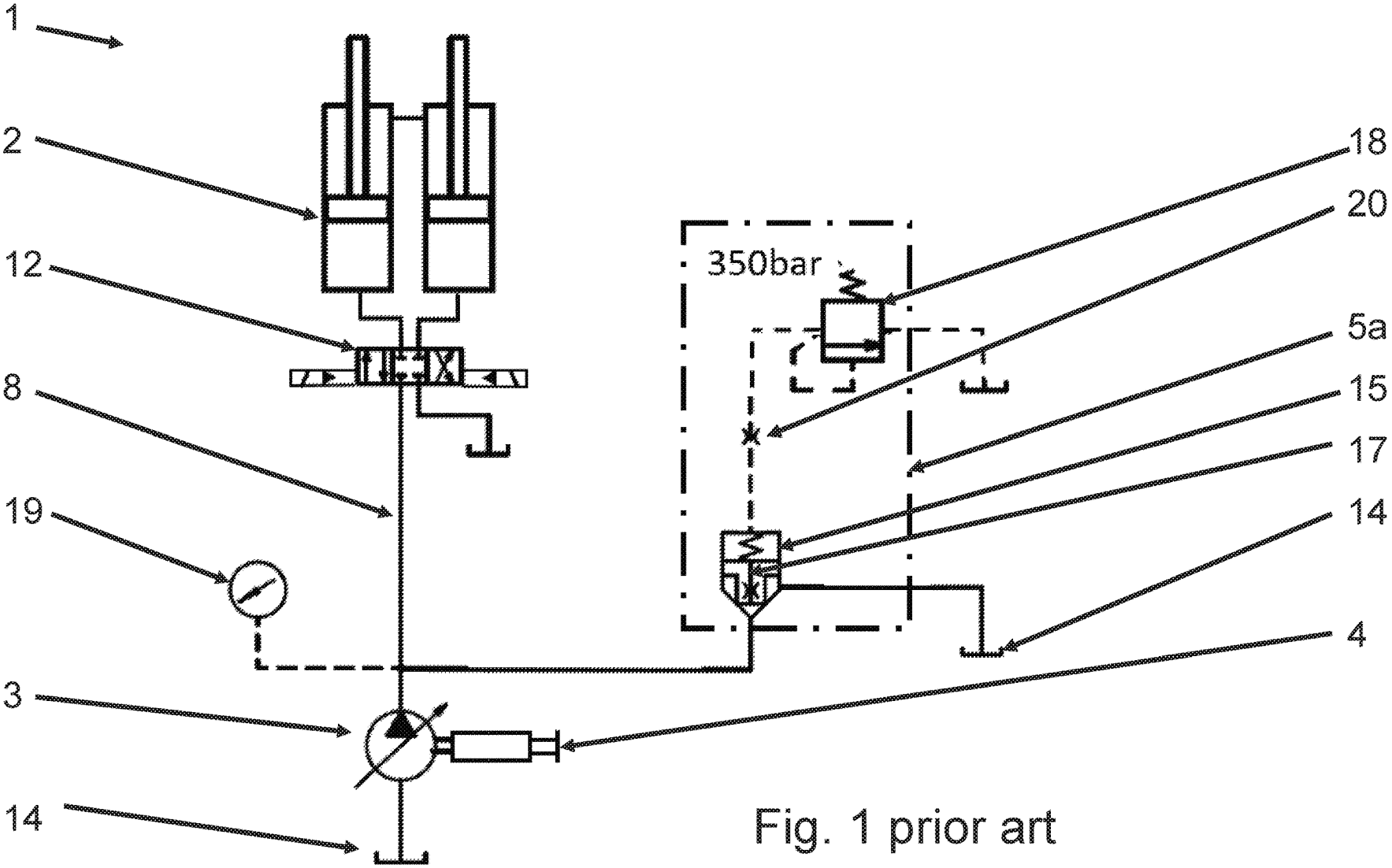
Fig. 1 prior art

pressure of the hydraulic fluid are adjustable through a joint adjusting element.

13 Claims, 5 Drawing Sheets

(51) Int. Cl.

| | |
|---|---|
| ***F04B 49/00*** | (2006.01) |
| ***F04B 15/02*** | (2006.01) |
| ***F04B 49/22*** | (2006.01) |
| ***F04B 53/10*** | (2006.01) |
| ***F04B 9/117*** | (2006.01) |

(52) U.S. Cl.
CPC ..... *F04B 49/002* (2013.01); *F04B 49/22* (2013.01); *F04B 9/1176* (2013.01); *F04B 53/10* (2013.01); *F15B 2211/20553* (2013.01)

(58) Field of Classification Search
CPC ..... F04B 9/117; F04B 53/10; F04B 9/1176; F04B 9/08; F15B 2211/20553
See application file for complete search history.

(56) References Cited

FOREIGN PATENT DOCUMENTS

| | | | |
|---|---|---|---|
| DE | 19503986 | A1 | 8/1996 |
| DE | 10040737 | A1 | 2/2002 |
| DE | 102012216242 | A1 | 3/2014 |

OTHER PUBLICATIONS

International Preliminary Report on Patentability issued in PCT/EP2017/079962, dated May 31, 2019, 14 pages.
International Search Report issued in PCT/EP2017/079962, dated Feb. 14, 2018, 2 pages.

* cited by examiner

VISCOUS MATERIAL PUMP WITH ADJUSTABLE LIMITATION OF THE DELIVERY PRESSURE

CROSS-REFERENCE TO RELATED APPLICATION

This application is a U.S. 371 Application of International Application No. PCT/EP2017/079962, filed Nov. 21, 2017, which claims priority to Germany Patent Application No. 10 2016 122 392.1, filed Nov. 21, 2016, both of which are herein incorporated by reference in their entireties.

The invention relates to a thick matter pump including a hydraulically-driven two-cylinder piston pump for generating a thick matter delivery pressure and a hydraulic pump, which applies the two-cylinder piston pump with hydraulic fluid via a drive line, wherein the thick matter pressure is adjustably limited.

Such thick matter pumps are for example used to convey concrete from a feed hopper into a conveying line. The thick matter delivery pressure in the conveying line can, in stationary thick matter pumps, amount to far above 200 bar. The conveying lines used must be designed for such a thick matter delivery pressure.

In the construction of tall structures, such as, for example, high-rise buildings or bridge pylons, the conveying lines are laid upwardly vertically on the building and can bridge heights of up to 500 m or more. A concrete distributer boom is often connected on the upper end of the conveying lines, in order to distribute the upwardly-conveyed concrete onto the uppermost level of the construction site. Such a manner of concrete distributor boom, as a rule, includes an articulated boom, with which the concrete is distributed. For weight-related reasons, the articulated boom, as a rule, comprises conveying pipes, which are limited to a load of around 85 bar through a thick matter pressure. If a stoppage occurs in the conveying lines or conveying pipes of the distributor boom through blockages, a critical thick matter delivery pressure can, in particular if the concrete distributor boom is connected to the conveying line at lower height, set in, which pressure causes the conveying line or the weaker conveying pipes of the distributor boom to burst. A simple and securely adjustable limiting of the thick matter delivery pressure is required for this application.

The adjustable limiting of the thick matter delivery pressure is also expedient in other applications to safeguard equipment, such as e.g. concrete conveying hoses, connected to the thick matter pump.

In each case, the thick matter delivery pressure of the thick matter pump is to be adapted to the situation at the construction site, so that no critical thick matter delivery pressure can build up in the conveying pipes or lines connected to the thick matter pump, which pressure can cause the pipes or lines to burst.

In order to provide for a limiting of the thick matter delivery pressure, thick matter pumps used nowadays comprise a pre-set pressure regulation means of the hydraulic drive of the two-cylinder piston pump, which regulation means is, as a rule, fixedly factory-set prior to initial entry into service and is only accessible with difficulty. The ratio of thick matter delivery pressure to hydraulic pressure in a two-cylinder piston pump is, in principle, easily derivable via the ratio of the piston surfaces of the hydraulic cylinders and of the thick matter delivery cylinders to one another. If the hydraulic pressure rises above a fixedly pre-specified target value, the conveying capacity of the hydraulic pump is automatically reduced, in order to limit the hydraulic pressure, and therefore also the thick matter delivery pressure. This type of pressure regulation means is also referred to a pressure cut-off.

In order to safeguard the thick matter pump against errors in the pre-set pressure regulation, an adjustable pressure limiting valve is additionally provided in the prior art, which valve limits the pressure of the hydraulic fluid in the drive line to a maximum value. If, however, the set maximum pressure is set lower than the target pressure of the pressure regulation, this leads to the pre-set pressure regulation means being overridden, so that the conveying capacity of the hydraulic pump is no longer automatically reduced. Unnecessary losses result hereby, and the hydraulic fluid is heated.

If, by contrast, only the pressure regulation means of the hydraulic pump is changed, an error in this regulation will possibly not be compensated early enough through the pressure-limiting valve, which limits the pressure of the hydraulic fluid in the drive line to a maximum value, which leads to a reduction of the operational reliability of the thick matter pump with the conveying lines and pipes attached to this pump.

Against this background, the object of the invention is to make an improved thick matter pump available. In particular, the target pressure of the pressure regulation means and the maximum pressure of the hydraulic fluid are meant to be simply and securely adaptable to the individual circumstances at the respective construction site.

The invention achieves this object on the basis of a thick matter pump of the aforementioned type in that the at least one hydraulic pump comprises a pressure regulation means adjustable to a target pressure of the hydraulic fluid to limit the thick matter delivery pressure, and the pressure of the hydraulic fluid in the drive line is limited to an adjustable maximum pressure via an adjustable pressure limiting valve, wherein the target pressure of the pressure regulation means and the pressure of the hydraulic fluid are adjustable through a joint adjusting element.

The advantages achieved through this invention result therefrom that the target pressure of the pressure regulation means and the maximum pressure of the hydraulic fluid are adjustable, easily and non-susceptible to error, through a joint adjusting element. The pressure regulation means, easily adjustable in this way, simplifies the limiting of the thick matter delivery pressure through the adjustably regulated hydraulic pump. In order to furthermore ensure a high level of safety, the pressure of the hydraulic fluid, in the drive line, is automatically limited to a maximum value fitting the target value of the pressure regulation means via an adjustable pressure limiting valve.

The above-mentioned disadvantages of the prior art are solved thereby.

Advantageous embodiments and further developments of the invention result from the dependent claims.

According to an advantageous embodiment of the invention, it is provided that the adjusting element is configured to synchronously set the target pressure of the pressure regulation means and the maximum pressure of the hydraulic in such a way that the maximum pressure always lies above the target pressure by a pre-specified differential pressure. In this way, it is ensured that the settings, via the joint adjusting element, do not lead to any changing of the safety measures and efficiency of the thick matter pump.

A preferred embodiment provides that the adjusting element comprises a first pilot valve, adjustable to the target pressure of the hydraulic fluid, which valve is input-sidedly connected with an adjusting slide of the pressure regulation means of the hydraulic pump and is output-sidedly relieved into a hydraulic reservoir, wherein the first pilot valve opens after reaching the target pressure. This first pilot valve constitutes a simple but secure possibility of cutting-off the pressure of the hydraulic fluid at a target pressure is specified.

The further development, in that the adjusting element comprises a second pilot valve, which is input-sidedly connected with a main stage of the pressure-limiting valve and output-sidedly connected with the input side of the first pilot valve, wherein the second pilot valve opens, from the pre-specified differential pressure, between input and output side, is particularly advantageous. This second pilot valve thus ensures that the maximum pressure pre-specified through the pressure limiting valve automatically always lies above the target pressure of the pressure cut-off by the differential pressure in the drive line, i.e, the maximum pressure, with a setting of the target pressure, is automatically correctly set to a maximum pressure fitting thereto. Therefore, undesired interactions between the pressure regulation means of the hydraulic pump and the pressure relief through the pressure-limiting valve reliably do not occur. Simultaneously, safety is always provided, as the main stage of the pressure-limiting valve opens if the pressure in the drive line exceeds the target value and reaches a pressure value lying above the target pressure by the suitably selected differential pressure. The pre-specified differential pressure between input and output side of the second pilot valve optimally amounts to around 20 bar, as a sufficient operational reliability of the thick matter pump is provided hereby.

Further advantageous is the embodiment, that the second pilot valve is not adjustable. It can hereby be ensured that the setting options via the adjusting element do not lead to a reduced operational reliability of the thick matter pump through manual settings at the second pilot valve.

An advantageous embodiment of the invention provides that the first pilot valve is adjustable via a handwheel. The setting option of the first pilot valve, via a handwheel, makes the adaptation of the thick matter pump to the circumstances at the respective construction site, for the individual intended purpose, particularly simple and secure.

According to an advantageous embodiment of the invention, it is provided that the handwheel is fixable and/or lockable. A fixing option of the handwheel prevents unwanted changes of the settings at the first pilot valve, and thusly to the adjusting element. The locking possibility of the handwheel in addition ensures that changes to the position of the handwheel only occur through authorized personnel.

A further advantageous embodiment of the invention is that the adjusting element comprises a third, non-adjustable pilot valve, connected in parallel to the first pilot valve, which opens upon reaching a maximum-permitted pressure. A third pilot valve which opens and relieves the pressure regulation means into a hydraulic reservoir, connected in parallel to the first pilot valve offers an additional safeguard in errors or too-high setting of the adjustable first pilot valve.

A preferred embodiment provides that a switching valve is located upstream the first pilot valve, in such a way that the third pilot valve is connected in parallel to the arrangement of first pilot valve and switching valve, wherein the switching valve selectively establishes or breaks the connection of the input side of the first pilot valve with the adjusting slide of the pressure regulation means. Such a switching valve enables the easy adjustment of the target pressure of the pressure regulation means between the target pressure set at the first pilot valve and the maximum-permissible pressure of the pressure regulation means, which is pre-specified through the third pilot valve. The limiting of the thick matter delivery pressure on the thick matter pump can hereby be very quickly adapted to the maximum-permissible pressure, without any change being needed at the first adjustable pilot valve.

An advantageous embodiment of the invention provides that the switching valve is latching and/or lockable. A latching possibility of the switching valve prevents unintentional position changes to the switching valve, and thusly to the adjusting element. The locking possibility of the switching valve additionally ensures that changes to the position of the switching valve only occur through authorized personnel.

Further features, details and advantages of the invention result based on the below description, as well as by means of the drawings. Exemplary embodiments of the invention are represented purely schematically in the following illustrations and are described in greater detail below. Objects or elements corresponding to one another are provided with the same reference characters in all figures. Shown are in:

FIG. 1 thick matter pump according to the prior art

Figure 2:
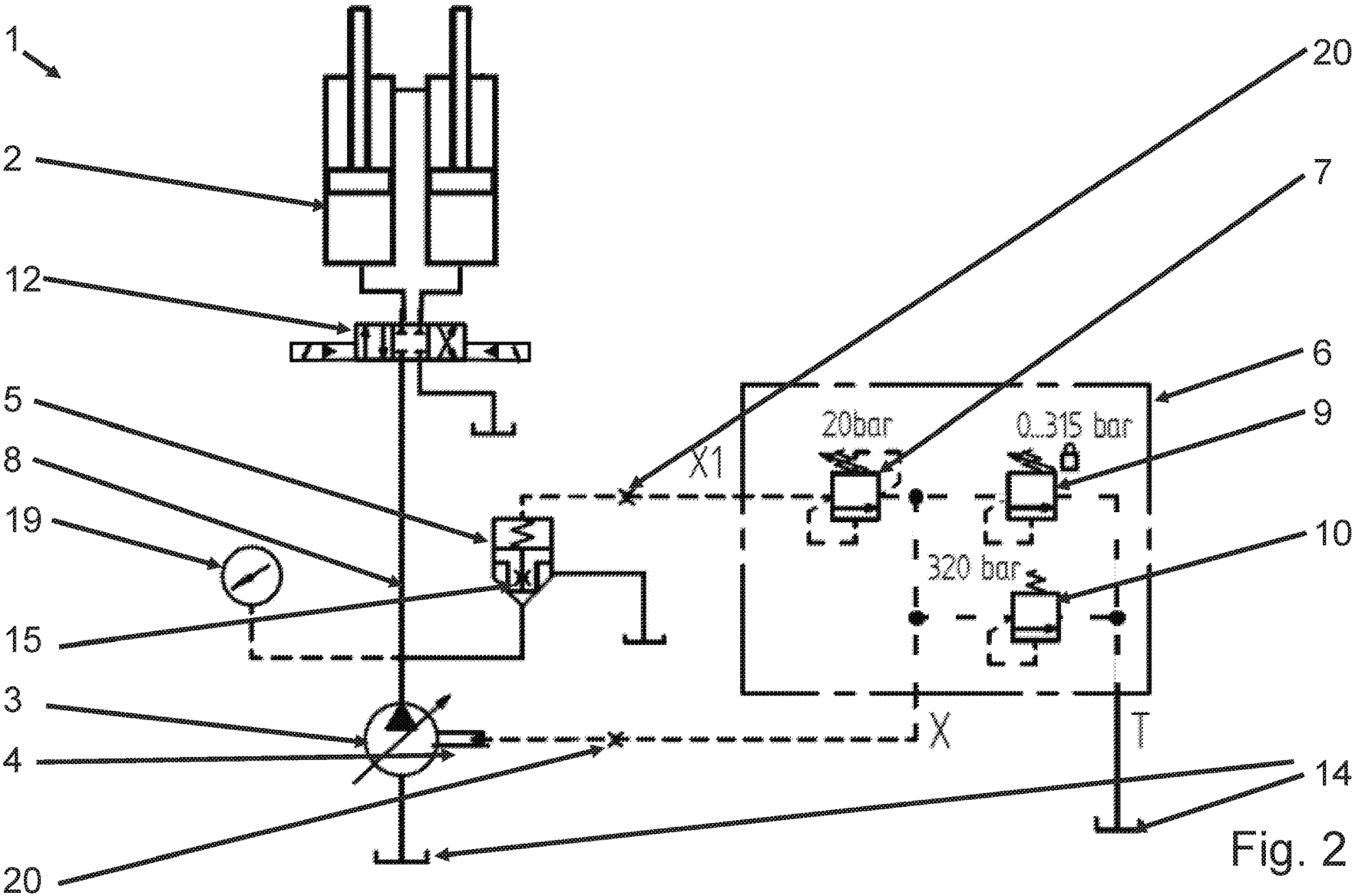
Figure 3:
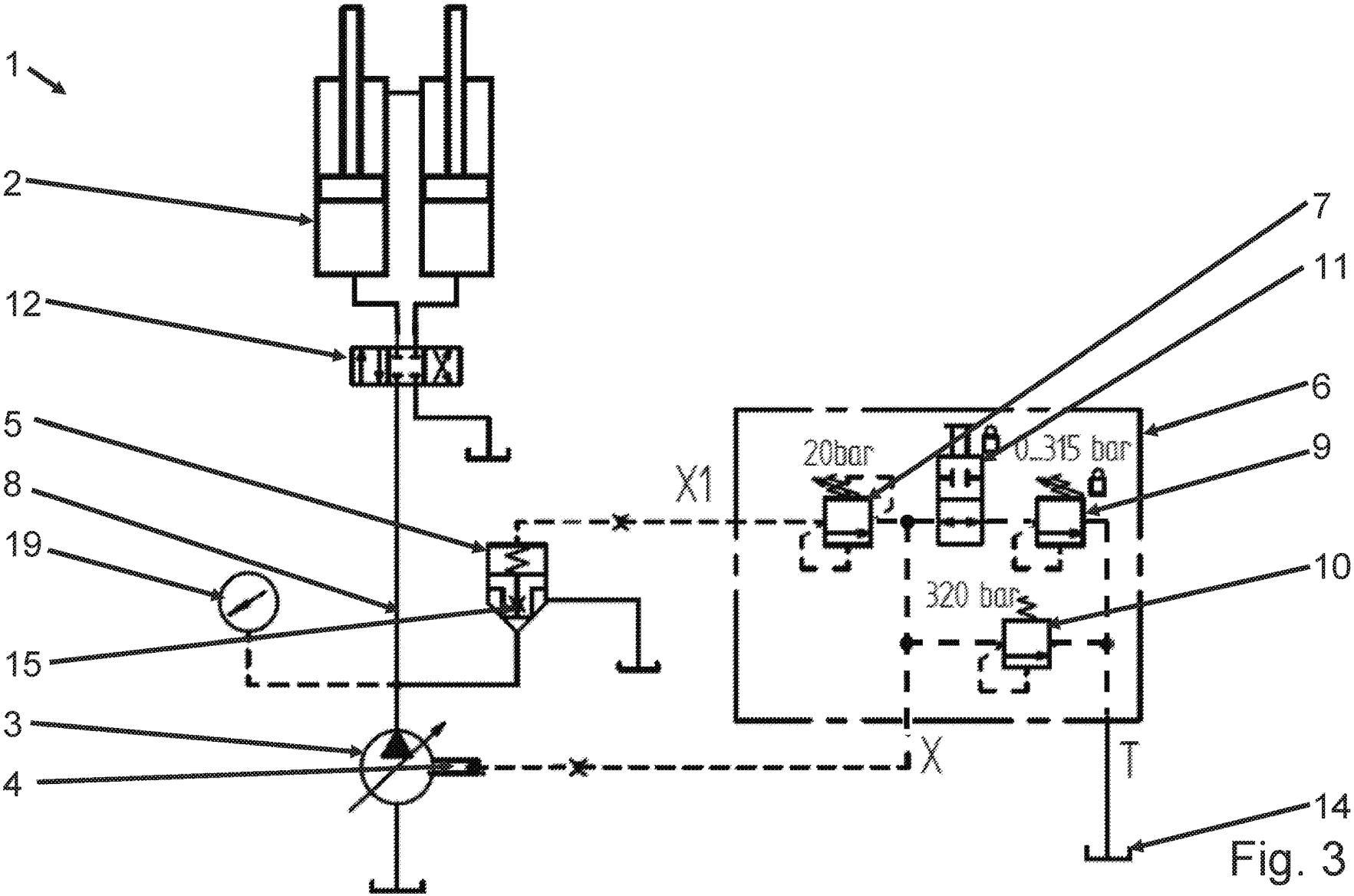
Figure 4:
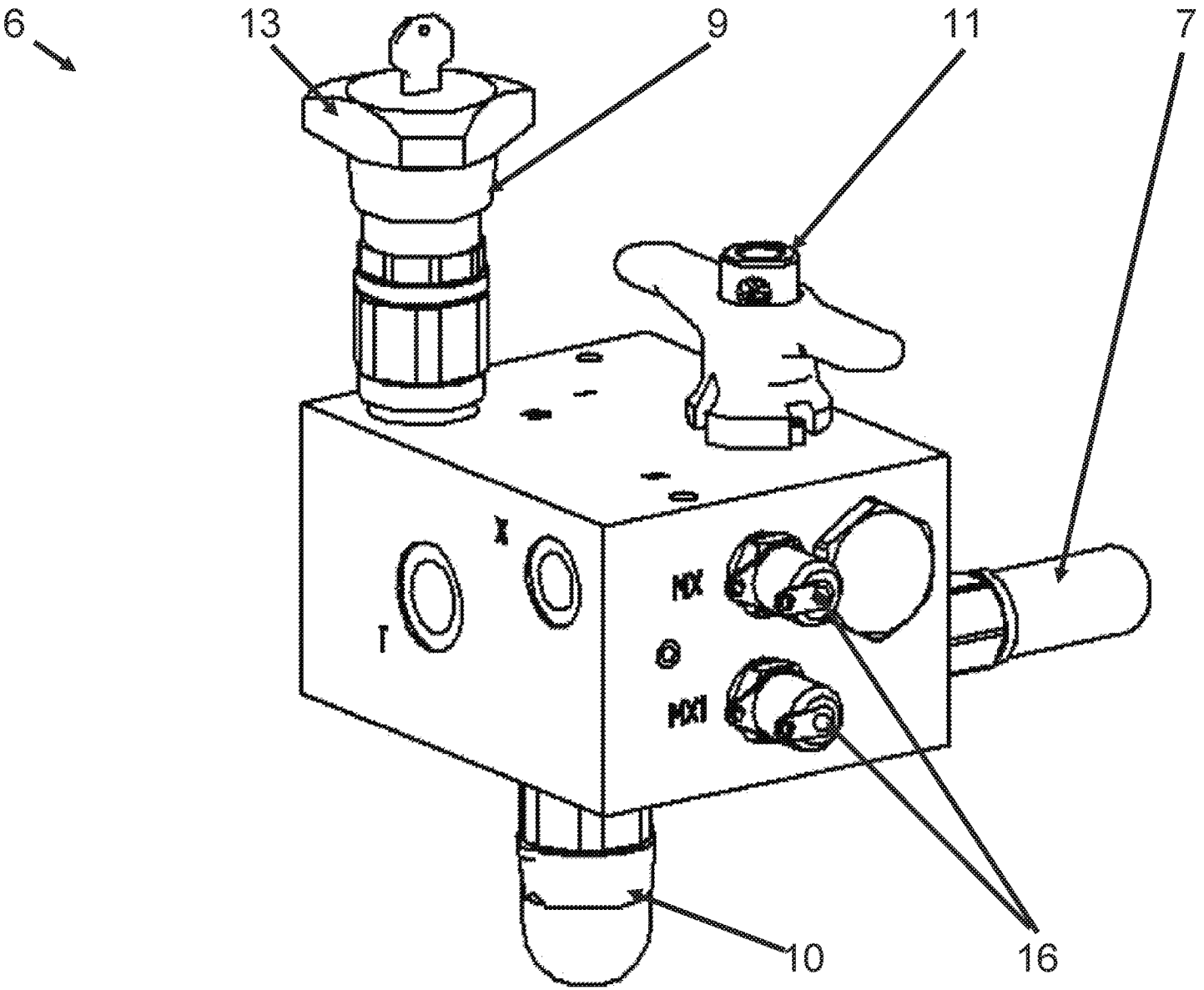
Figure 5:
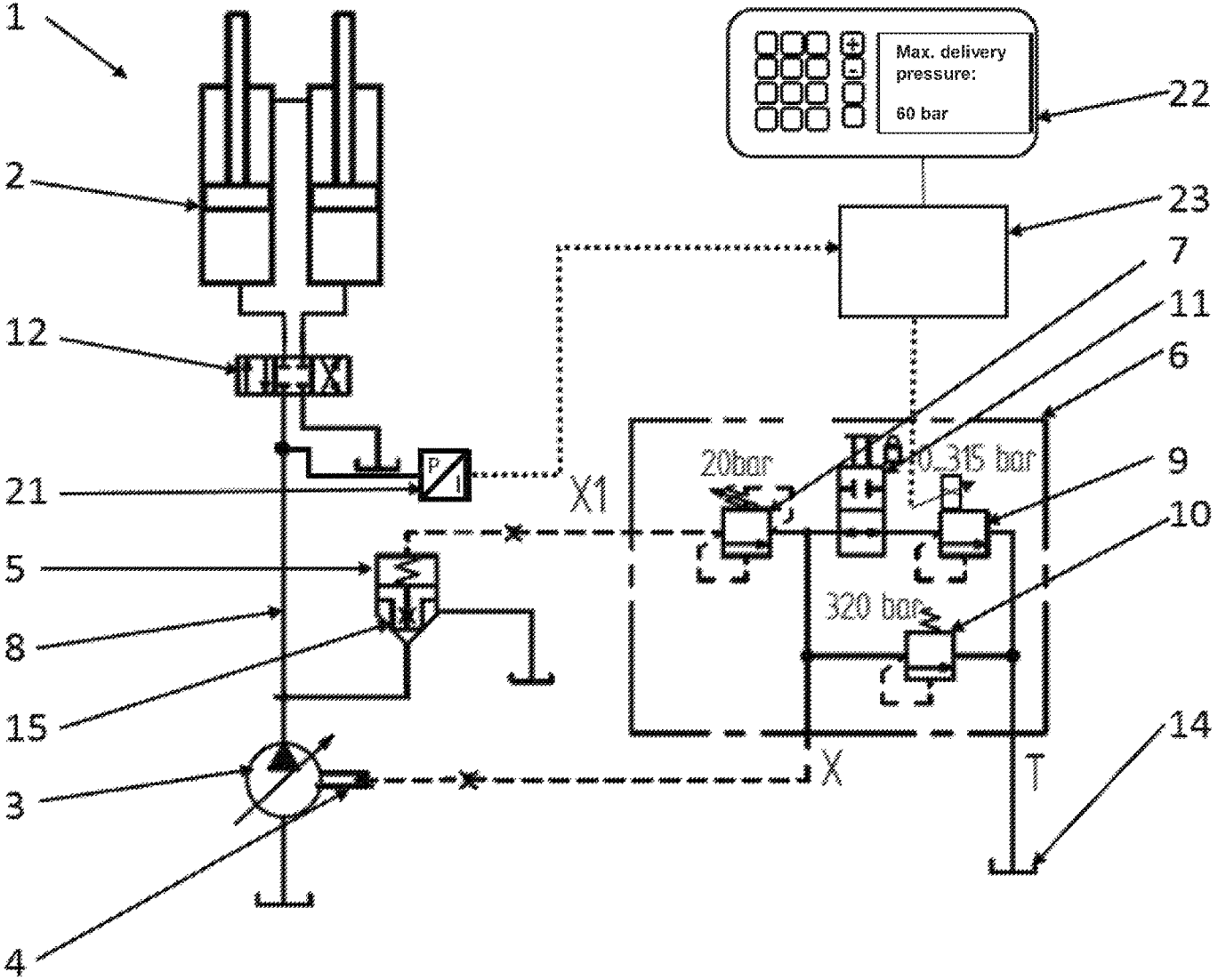

FIG. 2 thick matter pump according to the invention,

FIG. 3 thick matter pump according to the invention with switching valve,

FIG. 4 adjusting element according to the invention,

FIG. 5 variant of the thick matter pump with remotely-controllable pilot valve.

The illustration according to FIG. 1 shows, schematically and in detail, a thick matter pump 1 with a hydraulically driven two-cylinder piston pump 2 for producing a thick matter delivery pressure according to the prior art. The two hydraulic cylinders are indicated schematically and, via connecting lines and a switching controller 12, in this case e.g. an electro-hydraulically pilot-controlled 4/3-way valve, to a drive line 8, via which the two-cylinder piston pump 2 is applied hydraulic fluid by a hydraulic pump 3, for example an axial-piston variable-displacement pump. Via the switching controller 12, an alternating application of the two hydraulic cylinders of the two-cylinder piston pump occurs. Delivery pistons, not represented, are arranged at the upper ends of the schematically-indicated piston rods of the hydraulic cylinders, which project upwardly out of the hydraulic cylinders, which pistons are pushed back and forth by the hydraulic cylinders in delivery cylinders, thus generating the thick matter delivery pressure.

The hydraulic lines represented by solid lines in the figures are so-called working lines, which are designed for high hydraulic fluid flows, whereas the hydraulic lines represented by dashed lines represent control or measuring lines, which are designed for smaller hydraulic fluid flows.

A manometer 19 is coupled to the drive line 8, between the switching controller 12 and the hydraulic pump 3, at which the current pressure of the hydraulic fluid is directly readable.

The thick matter delivery pressure can, via the ratio of the active piston surface of the hydraulic cylinder and the thick matter delivery cylinder to one another, be derived.

The setting of the maximum target value of the pressure regulation means of the hydraulic pump is manually set by means of an adjusting slide 4 arranged on the hydraulic pump 3. As soon as the pressure of the hydraulic fluid in the drive line 8 reaches this target value, the pumping capacity of the hydraulic pump 3 is automatically reduced so that, upon reaching this threshold value, no losses result in the hydraulic system. This target value is, as a rule, factory and permanently pre-set at the initial entry into service, and should, as a rule, not be changed.

If the pressure limiting at the hydraulic pump 3 e.g. due to a jammed adjusting slide 4, does not respond, another pressure limiting unit 5*a* is attached to the working line 8 for security. This pressure limiting unit 5*a* includes the main stage 15 of the pressure limiting valve, with a downstream pilot valve 18. The hydraulic pressure of the working line 8 is made to pass through the passage channel 17 equipped with a nozzle, through the main stage 15, through a further damping nozzle 20, to the pilot valve 18. Upon reaching a threshold pressure, which should lie somewhat above the target value of the target value set at the hydraulic pump 3, the pilot valve 18 and thus also the main stage 15 of the pressure limiting unit 5*a* opens, so that the drive line 8 is directly connected with the hydraulic reservoir 14, and the pressure built-up by the hydraulic pump 3 is thusly decreased. Because opening the pressure limiting unit 5*a* causes a high power loss, however, this should only take place in the event of failure of the pressure regulation means via the hydraulic pump 3. For this reason, the threshold pressure of the pressure limiting unit is to be set always somewhat higher, for example 20 bar, than the target value at the hydraulic pump 3.

If a reduction of the maximum permissible thick matter delivery pressure is needed, for example if conveying lines are connected to the two-cylinder piston-pump 1, which can handle only lower delivery pressures, both threshold values would therefore have to be adjusted manually and independently, which, in practice, is only possible with great effort.

The representation according to FIG. 2 schematically and in detail shows a thick matter pump 1 with a hydraulically-driven two-cylinder piston pump 2 for generating a thick matter delivery pressure according to the invention. The functioning substantially corresponds to the pump 1 represented in FIG. 1, which is why, in the following, only the setting of the thick matter delivery pressure according to the invention is explained.

In the exemplary embodiment illustrated here, a so-called open hydraulic system is employed, in which the hydraulic pump 3 always pumps the hydraulic fluid in the same direction and suctions the hydraulic fluid from a hydraulic reservoir (tank) 14. The invention is, however, also applicable on known closed hydraulic systems in which the switching of the pumping direction of the hydraulic cylinders of the two-cylinder piston-pump 2 occurs in that the pump direction of the hydraulic pump 3 is reversed via a switching controller.

In order to achieve the high volume flows in connection with the high pump pressure of the hydraulic fluid, often two hydraulic pumps 3 connected in parallel are also employed, which is not represented here for reasons of clarity.

The thick matter delivery pressure generated by the thick matter pump 1 allows itself to be adjustably limited. To that end, the thick matter pump 1 comprises an adjusting element 6, via which the target pressure of a pressure regulation means and the maximum pressure of the hydraulic fluid, in the drive line 8, are jointly adjustable. Via the pressure regulation means, the hydraulic pump 3 can be regulated to cut off the thick matter delivery pressure, in that a target pressure of the hydraulic fluid is set in the pressure regulation means. To that end, the adjusting element 6 is connected to the adjusting slide 4 of the pressure regulation means, on the hydraulic pump 3, via the connection X. The pressure of the hydraulic fluid generated by the hydraulic pump 3 in the drive line 8 is limited to a maximum pressure adjustable by the pressure limiting valve 5. To that end, the adjusting element 6 is connected with the main stage 15 of the pressure limiting valve 5 via the connection X1. The adjusting element 6 is designed in such a manner that the target pressure of the pressure regulation means and the maximum pressure of the hydraulic fluid can be set synchronously. In this way, the maximum pressure of the hydraulic fluid in the drive line 8 always lies above the target pressure of the pressure regulation means by a pre-specified differential pressure. The adjusting element 6 comprises a first pilot valve 9 adjustable to the target pressure of the hydraulic fluid, which valve is input-sidedly connected with the adjusting slide 4 of the pressure regulation means of the hydraulic pump 3 and is output-sidedly relieved into a hydraulic reservoir 14. The first pilot valve 9 opens automatically upon reaching the set target pressure in the pressure regulation means and, in this way, very simply makes sure that the set target pressure is maintained. In the exemplary embodiment, the target pressure, in the pressure regulation means, can be set between 0 and 315 bar via the first pilot valve 9. A second pilot valve 7 of the adjusting element 6 is input-sidedly connected with the main stage 15 of the pressure limiting valve 5 and is output-sidedly connected with the input side of the first pilot valve 9. This second pilot valve 7 has the feature of adding up the backpressure from the downstream side directly onto the adjusting value set via the adjusting spring and opens as of a pre-specified differential pressure between input and output side and thusly ensures the limiting of the pressure fitting the set target value, in the drive line 8, via the pressure limiting valve 5. 20 bar are indicated as a pre-specified differential pressure in the exemplary embodiment. For reasons of operational reliability, the second pilot valve 7 adjustably represented here is preferably permanently factory-pre-set, i.e. the pre-specified pressure differential at which the pilot valve switches does not permit itself to be changed. In this way, the second pilot valve 7 acts upon the main stage 15 of the pressure limiting valve 5 to safeguard in such a way that the pressure limiting valve 5 pressure-relieves the drive line 8 as soon as the pressure of the hydraulic fluid, in the drive line 8, exceeds a value which lies above the target value of the pressure regulation means of the hydraulic pump 3 set at the first pilot valve 9. The adjusting element 6 further comprises an optional, non-adjustable third pilot valve 10, connected in parallel to the first pilot valve 9, which third valve, upon reaching a maximum permitted pressure, unloads into the hydraulic reservoir 14. The maximum-permissible pressure achievable here is, in the exemplary embodiment, specified with 320 bar. This maximum permitted system pressure is preset in the factory. This third pilot valve 10 makes sure that, in errors at the first pilot valve 9, am overloading of the entire system of the thick matter pump does not occur. In this way, the first pilot valve 9 and the third pilot valve 10 act directly upon the adjusting slide 4 for the pressure cut-off of the hydraulic pump of the hydraulic pump regulator. Through the parallel connection with the first pilot valve 9, the safeguard is continuously ensured through the third pilot valve 10.

The nozzles 20 serve the purpose of limiting the through-flow volume of the hydraulic fluid in the simultaneous through-passing of the hydraulic pressure, so that the pilot valves 7, 9, 10 and the adjusting slide are only made to react in a damped manner.

FIG. 3 schematically and in detail shows a thick matter pump 1 according to FIG. 1, wherein here, the adjusting element 6 comprises an additional switching valve 11. The switching valve 11 is connected upstream of the first pilot valve 9, in such a way that the third pilot valve 10 is connected in parallel to the arrangement of the first pilot valve 9 and switching valve 11, wherein the switching valve 11 selectively establishes or breaks the connection of the input side of the first pilot valve 9 with the adjusting slide 4 of the pressure regulation means. The switching valve 11 hereby makes the simple adjustment of the target pressure of the pressure regulation means between the target pressure set at the first pilot valve 9 and the maximum permitted system pressure at the third pilot valve 10 possible. In this way, the limiting of the thick matter delivery pressure can be adapted very quickly, without setting changes at the first adjustable pilot valve 9 being needed. Preferably, switching valve 11 is configured as a ball valve. The adjusting element 6 can thusly also simply be returned to the lower, set pressure via the switching valve 11. In FIG. 4, a constructive implementation of the adjusting element 6 according to FIG. 2 is shown schematically from the outside. The adjusting element 6 is configured as a special block and can be positioned at a location of the thick matter pump 1 (FIG. 1 or 2) easily reachable by the user. As can be discerned, the first pilot valve 9 allows itself to be set via a handwheel 13. In addition, the handwheel 13 is fixably and lockably configured. In this way, the setting value at the first pilot valve 9 allows itself to be secured. The shown switching valve 11 also allows itself to be simply managed and is latchingly as well as lockingly configured. The adjusting element 6 additionally has measurement terminals 16, with which information about the pressure ratios in the adjusting element 6 can be tapped.

The operator of the machine can undertake the setting of the target value of the pressure limiting of the hydraulic pump 3 at the first pilot valve 9 in connection with the manometer 19. To that end, the two-cylinder piston-pump 2 is blocked, in that, for example, the switching controller 12 is placed in the central (locked) position and the hydraulic pump is set to full capacity. The pressure set at the first pilot valve 9 is then displayed on the manometer 19, because the capacity of the hydraulic pump 3, as described further above, is automatically limited to this pressure. In an error at the adjusting slide 4 on the hydraulic pump 3, a system pressure, which lies above the set target value by 20 bar, still results in the relief of the drive line 8 via the pressure limiting valve 5.

Via a respective converting diagram, the operator can thereby easily adjust the hydraulic pressure in such a way, that the maximum thick-matter delivery pressure cannot be exceeded.

The adjusting element 6 represented here as a structural unit can, for example, also be integrated in a hydraulic control block for the thick matter pump, as long as a simple settability and/or accessibility of the first pilot valve 9 is specified. The first pilot valve 9, but also the switching valve 11, could as well be electrically remotely-controllably adjustable. Furthermore, a spatially-separated arrangement of the valves of the adjusting element 6 is conceivable.

A variant of the invention, in which the first pilot valve 9 is electrically remotely-controllably adjustable, is represented in FIG. 5. The first pilot valve 9 is embodied here as an electrically-controlled proportional pressure limiting valve and is actuated by a control electronics 23. The control electronics 23 measure the hydraulic drive pressure of the two-cylinder piston-pump 2 by means of the pressure sensor 21, and therefrom derives the thick matter delivery pressure via the ratio of the active piston surfaces of the hydraulic cylinders and the thick matter delivery cylinders to one another.

By means of an operating unit 22, which is equipped with a keypad and a screen, as represented, or, for example, also with a touchscreen, the operator here just defines the desired maximum delivery pressure of the two-cylinder piston-pump 2. The control electronics 23 determines, from the hydraulic pressure measured by the pressure sensor 21 and from the maximum thick matter delivery pressure pre-specified by the operator, as already described further above, the correct setting of the first pilot valve 9, in a block two-cylinder piston-pump 2, and correspondingly sets it via the control line. Based on a pre-specified valve characteristic line, stored on behalf of the system, the control electronics 23 can set the first pilot valve 9, for example, also without the blocking of the two-cylinder piston-pump 2. With the help of the pressure sensor 21, the setting can be reviewed and, if necessary, readjusted.

With the switching valve 11 represented in FIG. 5, the pre-set remotely-controlled reduction of the threshold pressure of the pressure cut-off can, when needed, simply be overridden. I.e., upon actuation of the switching valve 11, the maximum pressure, pre-specified via the third pilot valve 10, is set again for the pressure cut off, which, in the example represented here, lies 20 bar below the threshold pressure of the threshold pressure defined by the second pilot valve 7 and the pressure limiting valve 5.

LIST OF REFERENCE CHARACTERS

1. thick matter pump
2. two-cylinder piston pump
3. hydraulic pump
4. adjusting slide
5. pressure limiting valve (invention), 5*a* pressure limiting unit (prior art)
6. adjusting element
7. second pilot valve
8. drive line
9. first pilot valve
10, third pilot valve
11. switching valve
12. switching controller (4/3 directional valve)
13. handwheel
14. hydraulic reservoir
15. main stage
16. measurement terminal
17. throughput channel (from the prior art)
18. pilot valve (from the prior art)
19. manometer
20. nozzles
21. pressure sensor
22. operating unit
23. control electronics

The invention claimed is:

1. A thick matter pump comprising:

a hydraulically-driven two-cylinder piston-pump configured to generate a thick matter delivery pressure; and a hydraulic pump configured to apply hydraulic fluid to the two-cylinder piston-pump via a drive line, the hydraulic pump including a pressure regulator that is adjustable to a target value of a pressure of the hydraulic fluid for limiting the thick matter delivery pressure, wherein the thick matter delivery pressure is adjustably limited, wherein the pressure of the hydraulic fluid is limited in the drive line, via an adjustable pressure-limiting valve, to an adjustable maximum pressure, wherein the target value of the pressure of the hydraulic fluid of the pressure regulator and the maximum pressure of the hydraulic fluid are adjustable through a joint adjusting element.

2. The thick matter pump of claim 1, wherein the joint adjusting element is configured to set the target value of the pressure of the hydraulic fluid of the pressure regulator and the maximum pressure of the hydraulic fluid synchronously such that the maximum pressure always lies above the target pressure by a pre-specified differential pressure.

3. The thick matter pump of claim 1, wherein the joint adjusting element includes a first pilot valve adjustable to the target value of the pressure of the hydraulic fluid, wherein a first input side of the first pilot valve is connected with an adjusting slide of the pressure regulator of the hydraulic pump, and wherein a first output side of the first pilot valve is connected to a hydraulic reservoir, wherein the first pilot valve opens upon reaching the target pressure.

4. The thick matter pump of claim 3, wherein the joint adjusting element includes a second pilot valve, wherein a second input side of the second pilot valve is connected with a main stage of the pressure-limiting valve, wherein a second output side of the second pilot valve is connected with the first input side of the first pilot valve, wherein the second pilot valve opens as of a pre-specified differential pressure between the second input side and the second output side.

5. The thick matter pump of claim 4, wherein the second pilot valve is not adjustable.

6. The thick matter pump of claim 3, wherein the first pilot valve is adjustable via a handwheel.

7. The thick matter pump of claim 6, wherein the handwheel is lockable.

8. The thick matter pump of claim 3, wherein the joint adjusting element comprises a non-adjustable third pilot valve, connected in parallel with the first pilot valve, wherein the third pilot valve opens upon reaching a maximum-permissible pressure.

9. The thick matter pump of claim 8, further comprising:

a switching valve located upstream from the first pilot valve such that the third pilot valve is connected in parallel to the arrangement of the first pilot valve and the switching valve, wherein the switching valve selectively establishes or breaks the connection of the first input side of the first pilot valve with the adjusting slide of the pressure regulator.

10. The thick matter pump of claim 9, wherein the switching valve is lockable.

11. The thick matter pump of claim 4, wherein the joint adjusting element comprises a non-adjustable third pilot valve, connected in parallel with the first pilot valve, wherein the third valve opens upon reaching a maximum-permissible pressure.

12. The thick matter pump of claim 11, further comprising:

a switching valve located upstream from the first pilot valve such that the third pilot valve is connected in parallel to the arrangement of the first pilot valve and the switching valve, wherein the switching valve selectively establishes or breaks the connection of the input side of the first pilot valve with the adjusting slide of the pressure regulator.

13. The thick matter pump of claim 12, wherein the switching valve is lockable.

* * * * *